US005895041A

United States Patent [19]

Nishimura

[11] Patent Number: 5,895,041

[45] Date of Patent: Apr. 20, 1999

[54] RECORDING PAPER CASSETTE

[75] Inventor: Minoru Nishimura, Ueda, Japan

[73] Assignee: Matsushita Graphic Communication Systems, Inc., Tokyo, Japan

[21] Appl. No.: 08/937,648

[22] Filed: Sep. 25, 1997

[30] Foreign Application Priority Data

Oct. 15, 1996 [JP] Japan ..... 8-293429

[51] Int. Cl.[6] ..... B65H 1/00

[52] U.S. Cl. ..... 271/171

[58] Field of Search ..... 271/171, 145

[56] References Cited

U.S. PATENT DOCUMENTS

| | | | |
|---|---|---|---|
| 4,786,042 | 11/1988 | Stemmie . | |
| 5,120,040 | 6/1992 | Worley | 271/171 X |
| 5,172,903 | 12/1992 | Haneda et al. . | |
| 5,297,787 | 3/1994 | Shirai . | |
| 5,346,197 | 9/1994 | Takano et al. | 271/171 X |

FOREIGN PATENT DOCUMENTS

| | | | |
|---|---|---|---|
| 59-227636 | 12/1984 | Japan | 271/171 |
| 63-315425 | 12/1988 | Japan | 271/171 |
| 4350025 | 12/1992 | Japan . | |
| 6303372 | 10/1994 | Japan . | |

*Primary Examiner*—David H. Bollinger
*Attorney, Agent, or Firm*—Greenblum & Bernstein P.L.C.

[57] ABSTRACT

A recording paper cassette includes a recording paper cassette body in which the leading side of recording paper in its transfer direction is fixed at the lower part of the recording device body in a roughly horizontal state, a cassette cover detachably attached to the recording paper cassette body, a first guide secured at the recording paper cassette body, which is able to position the end parts of the rear edge of placed recording paper in its transfer direction; and a second guide which is able to position the end part of recording paper in its width direction. The first guide is turnably provided on the bottom of the recording paper cassette body, and the second guide is slidably provided on the bottom of the recording paper cassette body.

13 Claims, 4 Drawing Sheets

RECORDING PAPER CASSETTE

BACKGROUND OF THE INVENTION

1. Field of the Invention

The present invention relates to a recording paper cassette for feeding recording paper to a facsimile apparatus, a copier, etc., and in particular relates to a recording paper cassette made integral with the apparatus, which is able to accommodate recording paper of different sizes.

2. Description of the Related Art

Conventionally, recording paper cassettes which are used for a facsimile apparatus, a copier, etc., (hereinafter merely called "equipment") are roughly classified into two types, ones of which are exclusive paper feeding cassettes, the sizes of which are different according to the sizes of recording paper to be accommodated, and in which the shapes of the recording paper regulating plate for registering the leading edges of recording paper are different, and the others of which are universal recording paper cassettes which are able to accommodate and feed paper corresponding to various sizes of recording paper.

In line with advancement of the recent down-sizing and personal utilization of facsimile apparatus, etc., more universal recording paper cassettes which are capable of accommodating various sizes of recording paper in a form of a single unit as in Japanese Patent Publication No. 3500025 of 1992 have been utilized than such a type in which a plurality of exclusive recording paper cassettes are required. However, with such a conventional construction described above, since many components are used, the entire equipment is made large-sized, thereby causing the production cost to be increased.

Therefore, an integral type of universal recording paper cassette, which is incorporated in equipment, like a printer, etc. used in a personal computer has been proposed as one of the embodiments of universal recording paper cassette. In this type, a member for regulating the width direction of recording paper is provided, whereby only the width direction of each size of recording paper is regulated to cause recording paper to be adequately fed to the recording section.

On the other hand, as for the lengthwise direction of recording paper, the recording paper is registered by an action of gravity by inclining the entirety of the paper feeding section. Therefore, no special regulating member, which regulates the rear end of recording paper, is provided. With such an integral paper feeding cassette described above, there are some advantages, by which the number of components can be further decreased in comparison with a detachable type universal recording paper cassette, and the production cost of equipment can be also decreased.

However, there is still a problem that since the paper feeding section is caused to greatly protrude diagonally upward, it is difficult to reduce the size of the entire equipment and there causes a limitation as for the places of installing equipment. Especially, as far as it is constructed that the action of gravity is utilized by inclining the entire paper feeding section, the paper feeding section is unavoidably installed upward of equipment. It is necessary to secure a considerably large space upward of the equipment.

The invention was developed in view of these problematic points, and it is therefore an object of the invention to provide a recording paper cassette which is able to decrease its installation space and is able to easily replace and supply recording paper.

SUMMARY OF THE INVENTION

In order to achieve the above object, a recording paper cassette according to the invention comprises a recording paper cassette body in which the leading edge side of recording paper in its transfer direction is fixed at the lower part of equipment in a roughly horizontal state, a cassette cover detachably attached to the paper feeding cassette body, and a recording paper guide secured at the paper feeding cassette body, wherein the recording paper guide has a first guide for positioning the edge part of the rear end side in its transfer direction of placed recording paper, and a second guide for positioning the edge part in the width direction of the recording paper.

Furthermore, the abovementioned recording paper cassette according to the invention is constructed so that the second guide includes a first engaging portion slidably engageable with the bottom of the recording paper cassette body, a second engaging portion selectively engageable with engaging means secured at a plurality of positions of the bottom of the recording paper cassette body, and a reference plane which is brought into contact with the side of the recording paper, wherein the reference plane is able to regulate the placing position of recording paper accommodated in the abovementioned recording paper cassette by changing the engaging positions of the abovementioned second guide in compliance with the size of recording paper. Furthermore, the abovementioned recording paper cassette according to the invention is constructed so that the first guide is, in its prone state, positioned on the bottom of bigger sized recording paper accommodated on the bottom of the paper feeding cassette body and placed on the abovementioned recording paper cassette while the same is turnably provided on the bottom of the recording paper cassette body and positions the edge part of smaller-sized recording paper placed on the abovementioned recording paper cassette in its erect state.

DESCRIPTION OF THE PREFERRED EMBODIMENT

Hereinafter, a further detailed description is given of preferred embodiments of the invention with reference to the accompanying drawings.

Figure 1:
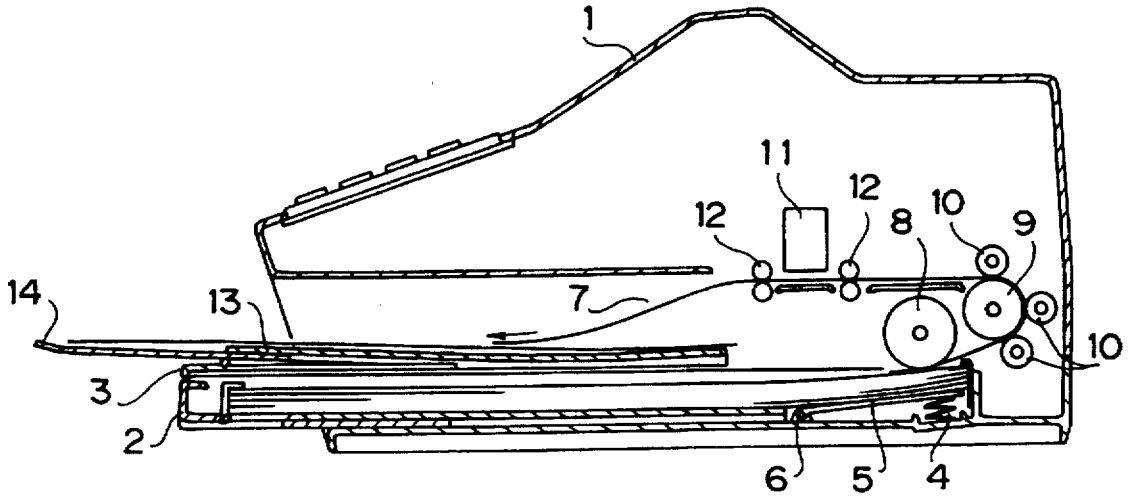
FIG. 1 is a cross-sectional view of the entire facsimile apparatus including a recording paper cassette according to the invention.

Firstly, the outline of the entire equipment is described, using FIG. 1. FIG. 1 is a cross-sectional view of the entire facsimile apparatus including a recording paper cassette according to the invention.

Facsimile machine body 1 has paper feeding cassette body 2 at its lower part. The recording paper cassette body 2 is made integral with the equipment body 1, wherein it is impossible to detach the same like a usual detachable type recording paper cassette. Cassette cover 3 is provided on the upper part of the recording paper cassette body 2 detachably from the recording paper cassette body. Spring 4 is provided on the bottom of the machine body 1, one end of which is connected to the bottom of the machine body 1, and the other end of which is connected to pick-up plate 5. The pick-up plate 5 is rotatable centering around a supporting axis 6 and is constructed so that the same can act to push recording paper 7 to a paper feeding roller 8 by the resiliency of the spring 4 according to the quantity thereof, whereby it is possible to adequately feed the recording paper 7 one by one. The recording paper sent out by the paper feeding roller 8 is caused to reach the recording head 11 between pinch rollers 10 which are rotated by a reversing roller 9.

At the recording head 11, data is recorded on recording paper by an ink jet system, and the recording paper is delivered by two pairs of transfer rollers 12. Furthermore, the upper surface of the cassette cover 3 takes a role as a delivery table 13, wherein the recording paper on which data is recorded will be placed onto the delivery table 3 of the cassette cover 3. Still furthermore, since an extension tray 14 which is extendible to the left side in FIG. 1, that is, to this side when being observed from the operator's side is provided at the cassette cover 3, it is possible to place bigger-sized recording paper.

Figure 2:
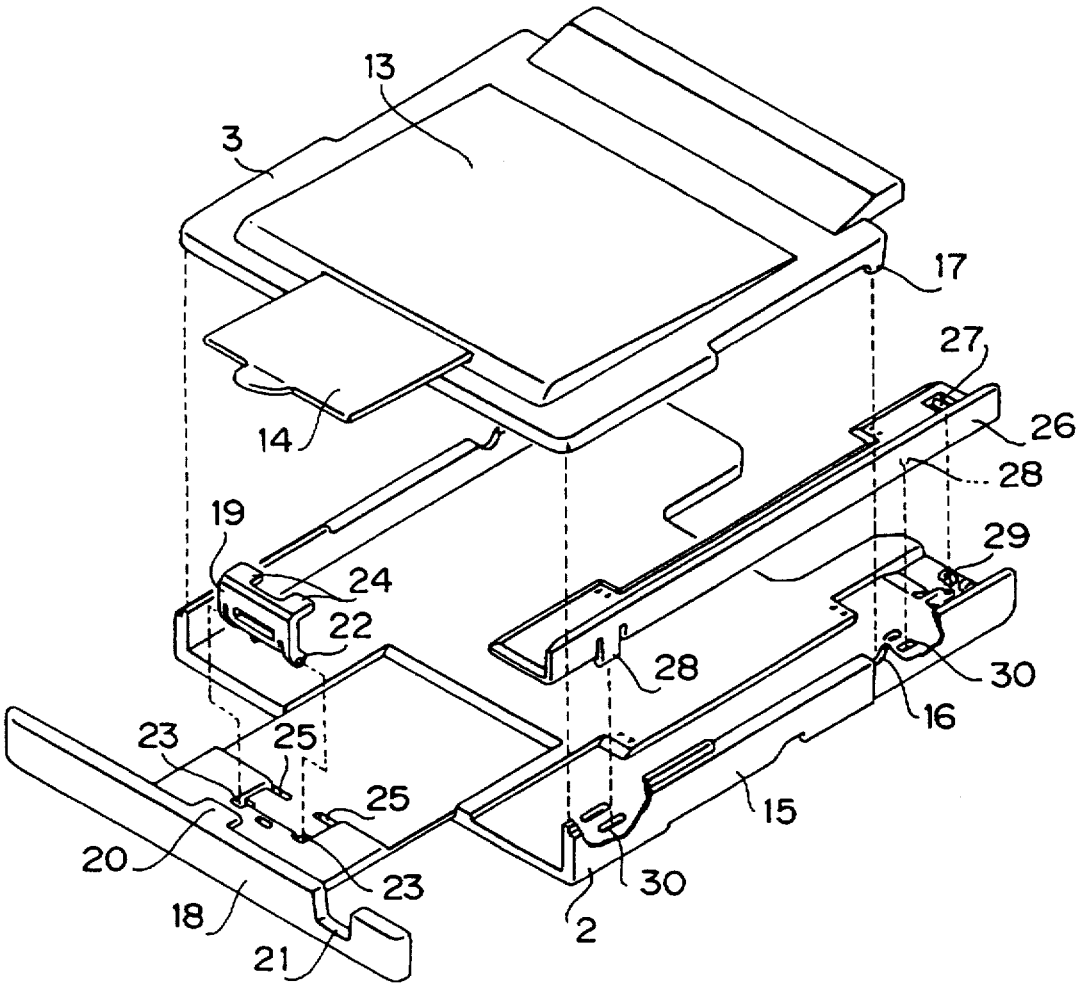
FIG. 2 is a disassembled perspective view of the recording paper cassette body according to the invention.

Next, with reference to FIG. 2, a description is given of the entire construction of recording paper cassette. FIG. 2 is a disassembled perspective view showing the entire construction of paper feeding cassette body 2. The recording paper cassette consists of paper feeding cassette body 2, cassette cover 3, fixed guide 18, first guide portion 19 and second guide 26.

The recording paper cassette body 2 is engaged with the cassette cover 3 at receiving groove 16 secured at side plate 15 of the recording paper cassette body 2 and at axial 17 secured at the cassette cover 3, and the cassette cover 3 is constructed so as to be turned upward centering around the engaging according to the necessity of supplying, replacing recording paper, and adjusting the guide, etc. described above. Next, a description is given of the fixed guide 18 and the first guide 19, which regulate the rear end of recording paper, with reference to FIG. 2 and FIG. 6 which shows the cross-section thereof.

Figure 6:
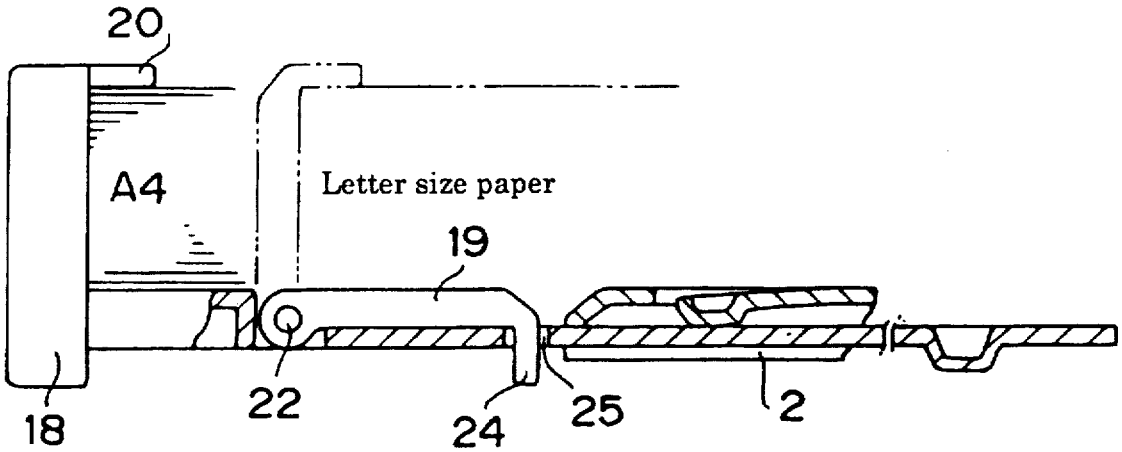
FIG. 6 is a cross-sectional view of a first guide according to the invention.

As illustrated in FIG. 6, the cross-section of the fixed guide 18 is L-shaped, wherein the longitudinal part thereof functions as a part of the recording paper cassette and simultaneously functions as its inherent fixed guide which regulates the rear end of recording paper. In this preferred embodiment, the fixed guide 18 is used to regulate the rear end of A4 sized recording paper. Recording paper regulation 20 which regulates the maximum height of recording paper is provided at the central part of the uppermost position of the fixed guide 18.

On the other hand, the bottom of the fixed guide 18 functions as a part of the plane, on which recording paper 7 is placed, together with the paper feeding cassette body 2. The bottom of the fixed guide 18 is slidable forward and backward on a groove (not illustrated) secured at the paper feeding cassette body 2 and can be drawn in the reverse direction of paper feeding, that is, to this side for an operator in order to supply and replace recording paper. The reason why the bottom of the fixed guide 18 is thus constructed is in that it is necessary to easily supply and replace recording paper because the recording paper cassette according to the invention is fixed at the equipment body 1 and is enclosed thereby. Furthermore, by using the fixed guide portion 18 with the same drawn out, it is possible to place legal-sized recording paper which is a little larger than A4 sized paper. Furthermore, as illustrated in FIG. 2, notched portion 21 is provided at the front side of the fixed guide 18 in order to glance at the remaining quantity of recording paper.

Still furthermore, the first guide 19 is used to regulate the rear end of smaller-sized recording paper. As shown in FIG. 2 and FIG. 6, and is rotatable centering around the protrusion 22 while the same is engaged with the bottom of the fixed guide 18 by a protrusion 22 secured at the first guide 19 and an engaging portion 23 secured at the bottom of the fixed guide 18.

In a case where letter-sized recording paper is used as in the preferred embodiment, the first guide 19 is fixed so as to be erect as shown with broken lines in FIG. 6 and functions as a guide to regulate the rear end of recording paper. Recording paper regulating portion 24 is provided at the uppermost position of the first guide 19 as in the fixed guide 18, whereby the height of the maximum quantity of A4-sized recording paper is regulated.

On the other hand, in a case where A4 size recording paper which is larger than the letter size is used, no first guide 19 is required. Therefore, as shown with solid lines in FIG. 6, the first guide portion 19 is shifted down around the protrusion 22 and made lay on the bottom of the fixed guide 18. Herein, accommodation groove 25, in which the recording paper regulating portion 24 is able to be adequately placed, is provided on the bottom of the fixed guide 18, and it is constructed that the recording paper regulating portion 24 does not constitute any obstacle when the first guide 19 is placed in a laying state.

Figure 3:
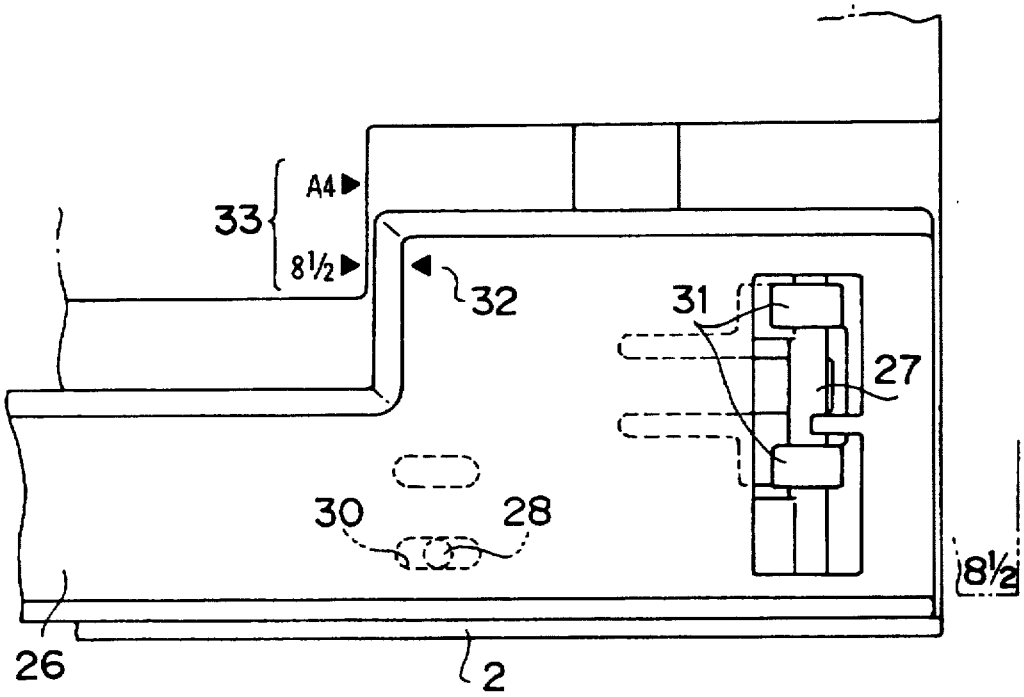
FIG. 3 is a plan view of a second guide according to the invention.
Figure 4:
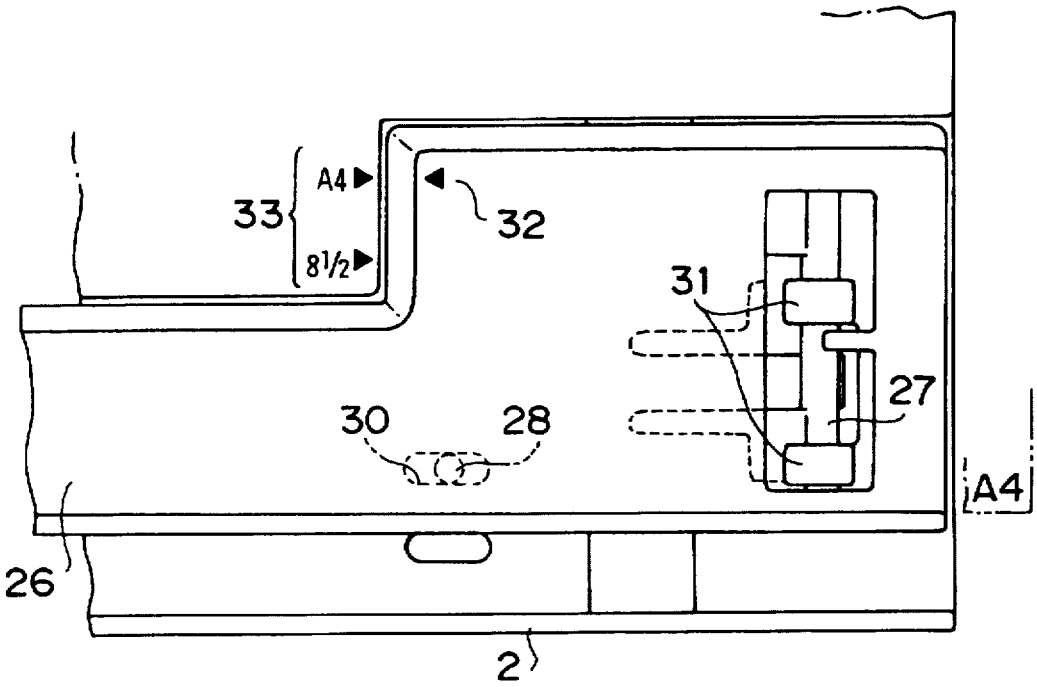
FIG. 4 is a plane view of the second guide according to the invention.
Figure 5:
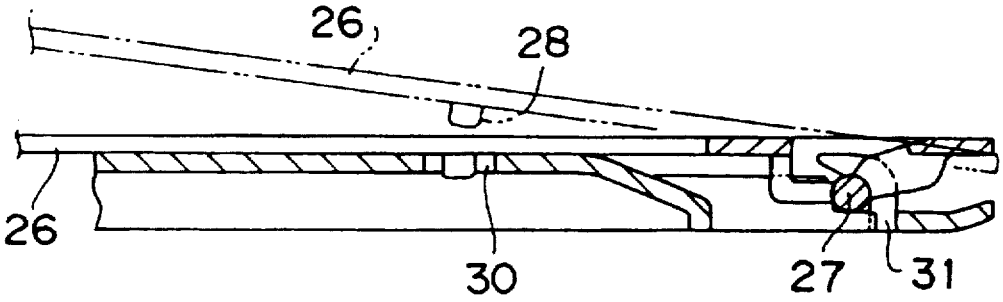
FIG. 5 is a cross-sectional view of the second guide according to the invention.

Next, a description is given of the second guide 26 which regulates the width direction of recording paper with reference to FIG. 2 to FIG. 6. Herein, FIG. 3 and FIG. 4 are plan views showing the engaging portion of the second guide 26 with the recording paper cassette body 2, and FIG. 5 is a cross-sectional view showing a state that the second guide 26 is lifted upward.

As illustrated in FIG. 2, the section of the second guide 26 is formed to be L-shaped and is composed of a plane for regulating the width of recording paper and a plane being engaged with the bottom of the recording paper cassette body 2. Furthermore, the second guide includes a slide axis 27 and a protrusion 28, wherein the slide axis 27 is engaged with engaging portion 29 secured at the recording paper cassette body 2 as the first engaging portion, and the protrusion 28 is engaged with fixing grooves 30 secured at the paper feeding cassette body 2 as the second engaging portion. That is, the second guide portion 26 will be fixed by the engaging portion 29 of the recording paper cassette body 2, protrusion portion 28 and fixing grooves 30. Furthermore, the protrusion portion 28 and fixing grooves 30 are to determine the position of recording paper in its width direction.

They are constructed so that although they do not move in the width direction of recording paper, their engagement can be easily cancelled in the vertical direction. As described later, this is because the second guide 26 must be easily turned upward. Furthermore, in the preferred embodiment, two of the fixing grooves 30 are provided at two points. By changing the engaging position, it is possible for the fixing grooves 30 to cope with two kinds of recording paper, A4 size and letter size or legal size.

On the other hand, the engaging portion 29 secured at the paper feeding cassette body 2 is composed of one supporting member 31 from the underside and two supporting members 31 from the upper side as shown in FIG. 3 and FIG. 4. These supporting members 31 support the slide axis 27 and cause the second guide 26 and recording paper cassette body 2 to be engaged with each other.

Since the engaging portion 29 is thus constructed, the second guide 26 is able to slide in the width direction of recording paper as shown in FIG. 3 and FIG. 4, and as shown in FIG. 5, the same is able to turn in the vertical direction centering around the slide axis 27.

Thus, the reason why they are able to turn as described above is that it is necessary to release the protrusion portion 28 engaged with the fixing grooves 30 by vertical turning the second guide 26. Furthermore, in FIG. 3 and FIG. 4, numeral 32 is the reference marking and numeral 33 is a recording paper size marking. They are signs for an operator to determine the position of the second guide in compliance with the size of recording paper.

A description is given of the motions of a paper feeding device, which is thus constructed, according to the invention, with reference to the drawings.

Firstly, a description is given of a case where a legal-sized recording paper is set. An operator opens the cassette cover 3 upward and draws out the fixed guide 18 to this side. As shown in FIG. 3, the operator makes sure that the reference marking 32 of the second guide 26 is coincident with the width position of letter size of the recording paper size marking 33, and simultaneously makes sure that, as shown with broken lines in FIG. 6, the first guide 19 is in an erect state. In this condition, the protrusion portion 28 of the second guide portion 26 is selectively engaged with the letter size side of two fixing grooves 30.

Next, the letter-sized recording paper is set on the recording paper cassette body 2 in a range equivalent to the quantity of recording paper regulated by the recording paper regulating portion 20. And by pushing in the fixed guide portion 18 and closing the recording paper cassette, the side at the recording paper side of the first guide 19 is brought into contact with the end face of recording paper, thereby causing the end face thereof to be pushed. Therefore, the rear end of recording paper is trued up. Finally, by correctly placing the cassette cover 3 onto the recording paper cassette body 2, the letter-sized recording paper can be completely set.

Thus, by pushing in the fixed guide 18 formed at the outer edge of the paper feeding cassette, the first guide 19 pushes the internally accommodated recording paper, thereby causing the end face of the recording paper to be trued up. Therefore, the work of supplying and replacing recording paper can be remarkably easily carried out without drawing out the recording paper cassette body from the equipment body and without inserting hands into the interior of the equipment.

Next, a description is given of a case where recording paper is changed to A4-sized paper from a state where the letter-sized recording paper is placed in the recording paper cassette body 2. An operator opens the cassette cover 3 upward, draws out the fixed guide 18 to this side and takes out the letter-sized recording paper placed in advance.

Next, the engagement of the protrusion portion 28 is cancelled from the second engaging portion 30, and the this side of the second guide 26 is raised up. Thus, as shown in FIG. 5, the second guide 26 is turned centering around the slide axis 27, whereby the second guide 26 is able to slide in the width direction of recording paper.

Accordingly, the recording paper is caused to slide in the width direction with reference to the reference marking 32 and recording paper size marking 33, wherein the second guide 26 is caused to fall down at the position of A4 size.

Herein, if it is selected that the protrusion portion 28 is engaged with the A4 size of two second engaging portions 30, the second guide 26 is fixed, as shown in FIG. 4, so that the width direction of the A4-sized recording paper is regulated.

Thus, by providing the second guide 26, it is not necessary to make cumbersome operations such as re-attaching the entire guide at an appointed position after removing the same as in the prior arts. With only a series of simple operation of pulling up the second guide 26, sliding and pushing in the same in the width direction of recording paper, it is possible to change the regulation position of recording paper. Especially, in a case where the slide axis 27, which constitutes a sliding means, and engaging portion 29 are provided at the leading edge side of recording paper in its transfer direction, it is possible to easily change the regulation position of recording paper at this side of the paper feeding cassette body 2 without inserting a hand deep into the equipment even though the recording paper cassette body 2 is included at the lower part of the equipment. The operation is remarkably improved.

Next, as shown with broken lines in FIG. 6, after the erect first guide 19 is shifted down and is made lay and the bottom of the recording paper cassette body 2 is made flat, A4-sized recording paper is set on the recording paper cassette body 2 in a range equivalent to the quantity of recording paper regulated by the recording paper regulating portion 24. And by pushing in the fixed guide 18, the first guide 19 will regulate the rear end of A4 recording paper. Finally, the cassette cover 3 is correctly placed on the paper feeding cassette body 2, whereby the equipment body 1 is started by the operation section (not illustrated).

Furthermore, the abovementioned description is based on a case where a recording paper cassette is applied to a facsimile apparatus. However, the invention is not limited to the above embodiment. It is widely applicable to recording equipment. As been made clear from the abovementioned description, according to the invention, since it is possible to cope with a plurality of sizes of recording paper by only one recording paper cassette as a universal recording paper cassette. Such attaching and detaching operations as in a case of using a detachable type recording paper cassette can be omitted. Therefore, space where a recording paper cassette of recording paper which is not used is placed can be eliminated.

Furthermore, the abovementioned paper feeding cassette is such a type where the recording paper cassette is fixed in the equipment. However, since it is possible to install the same in a horizontal state, it is not necessary to incline the recording paper cassette like the conventional types. Therefore, the place of installation of the recording paper cassette is not limited to upward of the equipment body. Such a mode where the same is included in the lower part of the equipment may be employed. Thereby, it is possible to attempt to decrease the scale of the equipment body.

Furthermore, since it is possible to simplify the structure of the recording paper cassette, the number of parts thereof can be decreased, and it is possible to achieve a lowering of the production cost of the equipment itself.

Furthermore, since it is possible to cause the recording paper guide to slide at the first engaging portion, it is possible to simply position the recording paper guide in compliance with various sizes of recording paper, and it is possible to simply change the engaging position of the recording paper guide at the second engaging portion. Therefore, a universal recording paper cassette in which the recording paper guide can be simply positioned according to the sizes of recording paper can be formed.

Still furthermore, since it is possible to cause the second guide to slide, it is possible to simply position the second guide in compliance with various sizes of recording paper, and the operation can be carried out at this side of the equipment when being observed from an operator when positioning the second guide, whereby even though the recording paper cassette is inwardly included in the equipment body and no hand can be deeply inserted thereinto when operating the cassette, it is possible to easily position the second guide. Since the guide positioned on the bottom of recording paper can be made stand or lay, the regulation position of the edge part of recording paper can be simply changed according to various sizes of recording paper. Still furthermore, since the structure can be made simple, it is possible to achieve a down-sizing of the equipment itself and a lowering of the production cost due to a decrease of the number of parts.

Furthermore, by forming a guide at the bottom of a paper feeding cassette which is constructed to be drawable, the guide can easily true up the end face of recording paper accommodated inside the cassette since the guide thereof pushes the recording paper by only operating to close the slide portion after supplying or replacing recording paper.

Still furthermore, in a case where small-sized recording paper is used, it is possible to make the guide positioned on the bottom of recording paper stand or lay, it is possible to easily change the regulation position of the end of recording paper according to various sizes of recording paper. To the contrary, in a case where large-sized paper is used, since a part of the paper feeding cassette can be concurrently used as a fixed guide, the position of the end of recording paper can be simply regulated. Therefore, since it is possible simplify the structure of the recording paper cassette, the number of parts can be decreased, and it is possible to achieve a down-sizing of the equipment itself and a lowering of the production cost.

What is claimed is:

1. A recording paper cassette comprising:

a recording paper cassette body in which recording paper is receivable;

a cassette cover detachably attached to the recording paper cassette body; and a recording paper guide rotatably positioned on a bottom of the recording paper cassette body to position a rear edge of the recording paper, wherein when the recording paper guide is in a standing state, the recording paper guide positions the rear edge of smaller-sized recording paper placed in the recording paper cassette body, while when the recording paper guide is in a lowered state, the recording paper guide is positioned under larger-sized recording paper placed in the recording paper cassette body.

2. A recording paper cassette comprising:

a recording paper cassette body in which recording paper is receivable;

a cassette cover detachably attached to the recording paper cassette body;

a recording paper guide rotatably positioned on a bottom of the recording paper cassette body for positioning a rear edge of the recording paper, wherein when the recording paper guide is in a standing state, the recording paper guide positions the rear edge of smaller-sized recording paper placed in the recording paper cassette body, while when the recording paper guide is in a lowered state, the recording paper guide is positioned under larger-sized recording paper placed in the recording paper cassette body; and a rear guide slidable with respect to the recording paper cassette body, the rear guide being installed in the recording paper cassette body with the recording paper guide positioned at a rear part of the recording paper cassette body, for positioning the rear edge of the larger-sized recording paper in the recording paper cassette body when the recording paper guide is in a lowered state.

3. A recording paper cassette comprising:

a recording paper cassette body in which recording paper is receivable;

a cassette cover detachably attached to the recording paper cassette body; and a recording paper guide installed on a bottom of the recording paper cassette body, the recording paper guide positioning a side edge of the recording paper, wherein a front end of the recording paper guide is slidably mounted in the recording paper cassette body, and a rear end of the recording paper guide is selectively fastenable to one of a plurality of engaging portions positioned according to a size of the recording paper.

4. The recording paper cassette according to claim 3, the recording paper cassette having a rear guide slidable with respect to the recording paper cassette body, wherein the rear guide is installed at the rear part of the recording paper cassette body to position a rear edge of the recording paper in the recording paper cassette body.

5. A recording paper cassette comprising:

a recording paper cassette body in which recording paper is receivable;

a cassette cover detachably attached to the recording paper cassette body;

a recording paper guide rotatably positioned on a bottom of the recording paper cassette body to position a rear edge of the recording paper, wherein, when the recording paper guide is in a standing state, the recording paper guide positions the rear edge of smaller-sized recording paper in the recording paper cassette body, while when the recording paper guide is in a lowered state, the recording paper guide is positioned under larger-sized recording paper in the recording paper cassette body; and another recording paper guide positioned on the bottom of the recording paper cassette body to position a side edge of the recording paper, wherein a front end of the another recording paper guide is slidably mounted in the recording paper cassette body, and a rear end of the another recording paper guide is selectively fastened to one of a plurality of engaging portions positioned according to a size of the recording paper.

6. A recording apparatus for recording on recording paper supplied from a recording paper cassette, the recording paper cassette comprising:

a recording paper cassette body in which the recording paper is receivable;

a cassette cover detachably attached to the recording paper cassette body; and a recording paper guide rotatably positioned on a bottom of the recording paper cassette body to position a rear edge of the recording paper, wherein when the recording paper guide is in a standing state, the recording paper guide positions the rear edge of smaller-sized recording paper in the recording paper cassette body, while when the recording paper guide is in a lowered state, the recording paper guide is positioned under larger-sized recording paper in the recording paper cassette body.

7. A recording apparatus for recording on recording paper supplied from a recording paper cassette, the recording paper cassette comprising:

a recording paper cassette body in which the recording paper is receivable;

a cassette cover detachably attached to the recording paper cassette body; and a recording paper guide positioned on a bottom of the recording paper cassette body to position a side edge of the recording paper, wherein a front end of the recording paper guide is slidably mounted in the recording paper cassette body, and a rear end of the recording paper guide is selectively fastened to one of a plurality of engaging portions positioned according to a size of the recording paper.

8. A recording apparatus for recording on recording paper supplied from a recording paper cassette, the recording paper cassette comprising:

a recording paper cassette body in which the recording paper is receivable;

a cassette cover detachably attached to the recording paper cassette body;

a recording paper guide rotatably positioned on a bottom of the recording paper cassette body to position a rear edge of the recording paper, wherein when the recording paper guide is in a standing state, the recording paper guide positions the rear edge of smaller-sized recording paper in the recording paper cassette body, while when the recording paper guide is in a lowered state, the recording paper guide is positioned under larger-sized recording paper in the recording paper cassette body; and a rear guide slidable towards the recording paper cassette body, positioned at a rear part of the recording paper cassette body, to position the rear edge of the recording paper in the recording paper cassette body.

9. A recording apparatus for recording on recording paper supplied from a recording paper cassette, the recording paper cassette comprising:

a recording paper cassette body in which the recording paper is received;

a cassette cover detachably attached to the recording paper cassette body;

a recording paper guide rotatably positioned on a bottom of the recording paper cassette body to position a rear edge of the recording paper, wherein a front end of the recording paper guide is slidably mounted in the recording paper cassette body, and a rear end of the recording paper guide is selectively fastened to one of a plurality of engaging portions positioned according to a size of the recording paper; and a rear guide slidable towards the recording paper cassette body, positioned at a rear part of the recording paper cassette body, to position the rear edge of the recording paper in the recording paper cassette body.

10. A recording apparatus for recording on recording paper supplied from a recording paper cassette, the recording paper cassette comprising:

a recording paper cassette body in which the recording paper is receivable;

a cassette cover detachably attached to the recording paper cassette body;

a recording paper guide rotatably positioned on a bottom of the recording paper cassette body to position a rear edge of the recording paper, wherein when the recording paper guide is in a standing state, the recording paper guide positions the rear edge of smaller-sized recording paper in the recording paper cassette body, while when the recording paper guide is in a lowered state, the recording paper guide is positioned under larger-sized recording paper in the recording paper cassette body; and another recording paper guide, positioned at the bottom of the recording paper cassette body, for positioning a side edge of the recording paper, wherein a front end of the another recording paper guide is slidably installed in the recording paper cassette body, and a rear end of the another recording paper guide is fastened to one of a plurality of engaging portions installed according to a size of the recording paper.

11. A method of setting recording paper in a recording paper cassette comprising a recording paper cassette body in which recording paper is receivable, a cassette cover detachably attached to the recording paper cassette body, and a recording paper guide rotatably positioned on a bottom of the recording paper cassette body to position a rear edge of the recording paper, wherein when the recording paper guide is in a standing state, the recording paper guide positions the rear edge of smaller-sized recording paper in the recording paper cassette body, while when the recording paper guide is in a lowered state, the recording paper guide is positioned under larger-sized recording paper in the recording paper cassette body, the recording paper setting method comprising:

opening the cassette cover;

placing the recording paper guide in the standing state;

setting the recording paper in the recording paper cassette body;

adjusting the rear edge of the recording paper to the recording paper guide; and closing the cassette cover.

12. A method of setting recording paper in a recording paper cassette comprising a recording paper cassette body in which recording paper is receivable, a cassette cover detachably attached to the recording paper cassette body, a recording paper guide rotatably installed on a bottom of the recording paper cassette body for positioning a rear edge of the recording paper, wherein when the recording paper guide is in a standing state, the recording paper guide positions the rear edge of smaller-sized recording paper in the recording paper cassette body, while when the recording paper guide is in a lowered state, the recording paper guide is positioned under larger-sized recording paper in the recording paper cassette body, and a rear guide slidable towards the recording paper cassette body, provided at a rear part of the recording paper cassette body, to position the rear edge of the recording paper in the recording paper cassette body, the recording paper setting method comprising:

opening the cassette cover;

placing the recording paper guide in the lowered state;

setting the recording paper in the recording paper cassette body;

sliding the rear guide to touch the rear edge of the recording paper in the recording paper cassette body; and closing the cassette cover.

13. A method of setting recording paper in a recording paper cassette comprising a recording paper cassette body in which recording paper is receivable, a cassette body detachably attached to the recording paper cassette body, a recording paper guide rotatably positioned on a bottom of the recording paper cassette body to position a side edge of the recording paper, wherein a front end of the recording paper guide is slidably positioned in the recording paper cassette body, and a rear end of the recording paper guide is selectively fastened to one of a plurality of engaging portions installed according to a size of the recording paper, the recording paper setting method comprising:

opening the cassette cover;

sliding the recording paper guide, while fastening the recording paper guide to one of the engaging portions located at a position corresponding to the size of the recording paper being utilized;

setting the recording paper in the recording paper cassette body; and closing the cassette cover.

* * * * *